US007241722B2

(12) United States Patent
Murase et al.

(10) Patent No.: US 7,241,722 B2
(45) Date of Patent: Jul. 10, 2007

(54) SLIDING COMPONENT

(75) Inventors: Hitotoshi Murase, Kariya (JP); Toshihisa Shimo, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 689 days.

(21) Appl. No.: 10/602,206

(22) Filed: Jun. 23, 2003

(65) Prior Publication Data

US 2004/0052649 A1 Mar. 18, 2004

(30) Foreign Application Priority Data

Jun. 24, 2002 (JP) ..... 2002-183017
Mar. 28, 2003 (JP) ..... 2003-091130

(51) Int. Cl.
*F01B 3/00* (2006.01)

(52) U.S. Cl. ..... 508/106; 508/107; 92/155

(58) Field of Classification Search ..... 508/107, 508/106
See application file for complete search history.

(56) References Cited

U.S. PATENT DOCUMENTS

| | | | | |
|---|---|---|---|---|
| 3,674,690 | A * | 7/1972 | Clow et al. | 508/168 |
| 4,082,896 | A * | 4/1978 | Wegwerth | 428/413 |
| 4,512,175 | A | 4/1985 | Kaku et al. | 72/360 |
| 5,401,574 | A * | 3/1995 | Masutani et al. | 428/338 |
| 6,071,990 | A * | 6/2000 | Yip et al. | 523/435 |
| 6,378,415 | B1 | 4/2002 | Sugiura et al. | 92/71 |
| 6,506,868 | B1 * | 1/2003 | Goda et al. | 528/27 |
| 6,525,160 | B1 * | 2/2003 | Goda et al. | 528/29 |
| 6,752,065 | B2 * | 6/2004 | Sugioka et al. | 92/12.2 |
| 6,983,681 | B2 * | 1/2006 | Iwata et al. | 92/12.2 |
| 7,004,061 | B2 * | 2/2006 | Kurihara | 92/12.2 |
| 7,021,194 | B2 * | 4/2006 | Shimo et al. | 92/71 |

FOREIGN PATENT DOCUMENTS

| | | |
|---|---|---|
| EP | 0 513 475 | 11/1992 |
| EP | 1 036 938 | 9/2000 |
| EP | 1 036 938 A2 | 9/2000 |
| EP | 1 114 834 | 7/2001 |
| EP | 1 114 834 A1 | 7/2001 |
| EP | 1 123 944 A1 | 8/2001 |
| EP | 1 188 924 | 3/2002 |
| EP | 1 188 924 A2 | 3/2002 |
| JP | 2001-240670 | 9/2001 |
| JP | 2001-319526 | 11/2001 |
| JP | 2002-012818 | 1/2002 |

OTHER PUBLICATIONS

German Office Action dated Feb. 1, 2007, received in corresponding German Patent Application No. 103 28 120.7-43 with English translation.

* cited by examiner

*Primary Examiner*—Ellen M. McAvoy
(74) *Attorney, Agent, or Firm*—Morgan & Finnegan, L.L.P.

(57) ABSTRACT

A sliding component has a metal base member and a coating layer. The metal base member has a sliding surface. The layer is made of silane-modified resin. The silane-modified resin is made from resin that is soluble in solvent and is equal to or higher in heat-resistant than epoxy resin. The coating layer is formed on the sliding surface.

17 Claims, 5 Drawing Sheets

SLIDING COMPONENT

BACKGROUND OF THE INVENTION

The present invention relates to sliding components such as a swash plate and a piston in a compressor for a vehicle air-conditioning system.

A compressor includes some sliding components in its inner mechanism. Generally, gas (for example, refrigerant gas such as chlorofluorocarbon) circulates in the compressor in accordance with the operation of the compressor. The gas atomizes lubricating oil stored in the compressor and transfers the atomized lubricating oil to the sliding portions of the respective sliding components so as to lubricate the sliding portions between the sliding components. However, when the compressor is restarted after it has been left stopped for a long time, lubricating oil on the sliding portions is possibly washed away by refrigerant gas.

For example, in a swash plate type compressor, pistons are coupled with a swash plate through shoes and reciprocate in respective cylinder bores by the rotation of the swash plate or by the oscillation of the swash plate. At an initial operation of the compressor, the swash plate and the shoes slide on each other before lubricating oil reaches sliding surfaces between the swash plate and the shoes. Additionally, before the lubricating oil reaches the sliding surfaces between the swash plate and the shoes, gaseous refrigerant reaches the sliding surfaces and washes away the lubricating oil that was left on the sliding surfaces from prior operation of the compressor.

After the compressor has started, the refrigerant gas returns to the compressor and begins to atomize the lubricating oil after a certain period (approximately a minute). During this period, the sliding portions that need lubrication are insufficiently lubricated while the compressor is operating. Therefore, some conventional techniques have been proposed for ensuring lubrication on the sliding portions during this initial period.

Conventionally, the surfaces of the sliding components, such as a swash plate and a piston, are coated with resin containing solid lubricant for several reasons. One is for preventing seizure of the sliding surfaces. Another is for improving abrasion resistance. The other is for reducing friction coefficient. The above technique is, for example, proposed in Unexamined Japanese Patent Publication No. 11-13638. As disclosed in the above publication, column [0006], the base material of a swash plate is made of iron series or aluminum series. The surface of the swash plate (strictly, the sliding surface against a shoe) is coated with a coating layer, such as tin and copper. The coating layer is further coated with a sliding layer made of polyamideimide resin and a solid lubricant such as molybdenum disulfide and graphite.

To further ensure reliability, further improvement of certain characteristics, such as seizure resistance, abrasion resistance and adhesion to the base member are required. For example, carbon dioxide gas has been recently considered for as a possible refrigerant for a compressor. To compress carbon dioxide gas as the refrigerant, large compression load acts on a swash plate through the pistons in comparison to the compression load when a chlorofluorocarbon series is used as the refrigerant. The conventional coating layers of tin or copper are insufficient to achieve sliding performance in such a severe condition. The improvement of certain characteristics, such as seizure resistance, abrasion resistance and adhesion to the base member, contributes to the improvement of the sliding performance.

SUMMARY OF THE INVENTION

In accordance with the present invention, a sliding component has a metal base member and a coating layer. The metal base member has a sliding surface. The layer is made of silane-modified resin. The silane-modified resin is made from resin that is soluble in solvent and is equal to or higher in heat-resistant than epoxy resin. The coating layer is formed on the sliding surface.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment of the present invention will now be described in reference to FIGS. 1 through 3B. The present invention is applied to a variable displacement swash plate type compressor C in the preferred embodiment. The left side and the right side respectively correspond to the front side and the rear side of the compressor C in FIG. 1.

Figure 1:
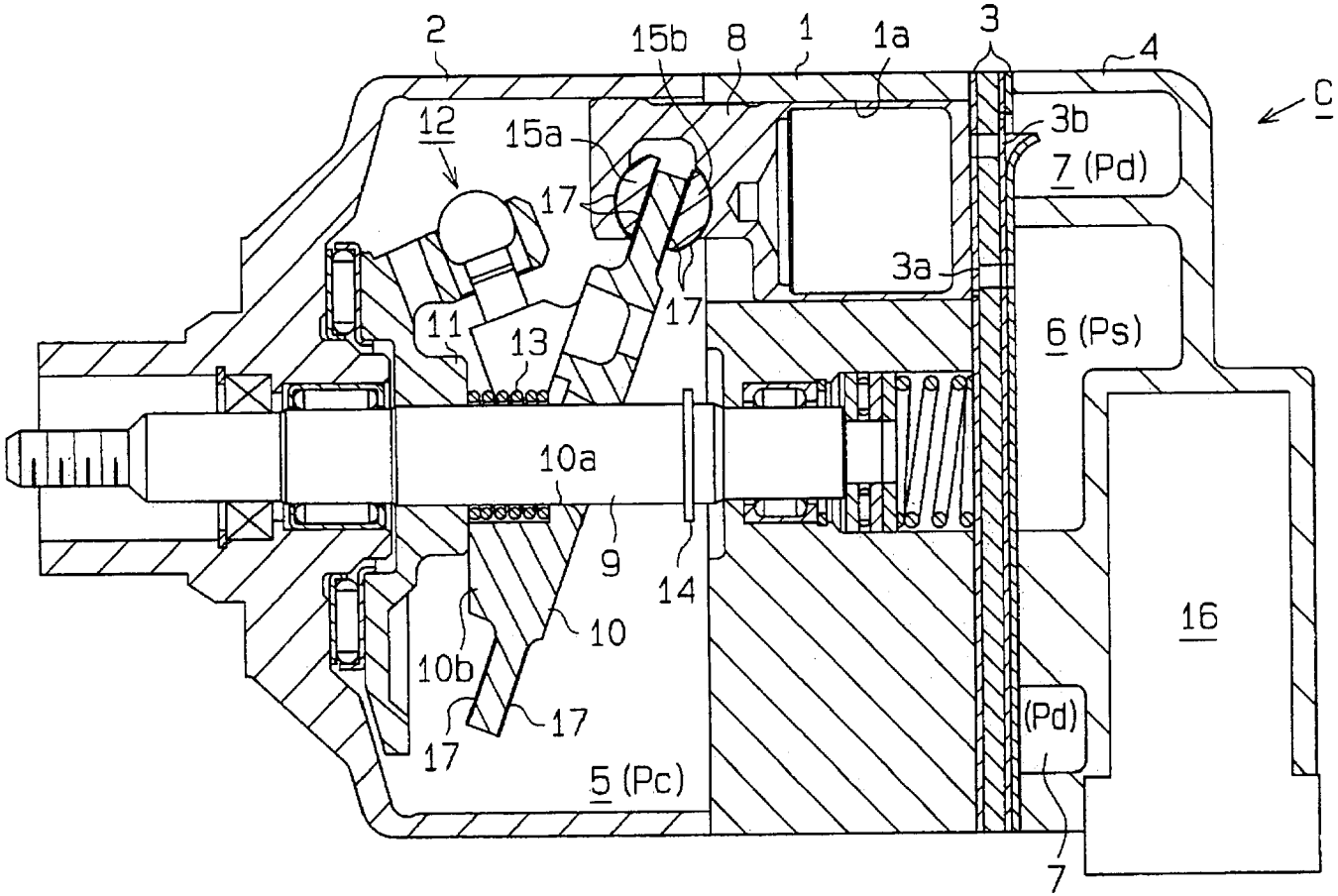
FIG. 1 is a longitudinal cross-sectional view of a variable displacement swash plate type compressor with sliding components according to a preferred embodiment.

FIG. 1 illustrates a longitudinal cross-sectional view of the variable displacement swash plate type compressor C with a sliding component according to the preferred embodiment. The compressor C includes a cylinder block 1, a front housing 2 and a rear housing 4. The front housing 2 is connected to the front end of the cylinder block 1. The rear housing 4 is connected to the rear end of the cylinder block 1 through a valve plate assembly 3. The cylinder block 1, the valve plate assembly 3 and the front and rear housings 2, 4 are fastened together by a plurality of through bolts (not shown) and form a housing of the compressor C.

The housing defines a crank chamber 5, a suction chamber 6 and a discharge chamber 7. The cylinder block 1 defines a plurality of cylinder bores 1*a*, only one of which is shown in FIG. 1, and each of the cylinder bores 1*a* accommodates a single-headed piston 8 so as to reciprocate. The suction chamber 6 and the discharge chamber 7 selectively communicate with each of the cylinder bores 1*a*.

A drive shaft 9 is rotatably supported by the cylinder block 1 and the front housing 2 through bearings and extends through the crank chamber 5. A swash plate or a cam plate 10 is accommodated in the crank chamber 5. The swash plate 10 forms a through hole 10*a* at its center, and the drive shaft 9 is inserted through the through hole 10*a*. A lug plate or a rotary support member 11 is fixedly connected to the drive shaft 9 in the crank chamber 5 so as to rotate integrally therewith. The swash plate 10 is operatively coupled to the drive shaft 9 thorough the lug plate 11 and a hinge mechanism 12 in such a manner that the swash plate 10 synchronously rotates with the drive shaft 9 and inclines relative to the drive shaft 9 in accordance with a displacement in the axial direction of the drive shaft 9.

A counter weight 10*b* is integrally formed with the swash plate 10 on the side opposite to the hinge mechanism 12 relative to the drive shaft 9. A coil spring 13 is wound around the drive shaft 9 and is arranged between the lug plate 11 and the swash plate 10. The coil spring 13 urges the swash plate 10 toward the cylinder block 1, that is, toward the direction to reduce the inclination angle of the swash plate 10. A circular clip 14 engages the drive shaft 9 and regulates the inclination of the swash plate 10 toward the direction to reduce the inclination angle by contacting the swash plate 10. Thus, the minimum inclination angle θ min of the swash plate 10 is regulated. On the other hand, the counter weight 10*b* of the swash plate 10 contacts the lug plate 11 to regulate the maximum inclination angle θ max of the swash plate 10. Incidentally, the inclination angle means an angle between the swash plate 10 and a surface perpendicular to the drive shaft 9.

The periphery of the swash plate 10 slidably engages each of the pistons 8 through a pair of shoes 15*a*, 15*b* so that all pistons 8 are operatively connected to the swash plate 10. The swash plate 10 rotates in accordance with the rotation of the drive shaft 9, and the rotation of the swash plate 10 is converted to the reciprocation of the pistons 8 through the shoes 15*a*, 15*b*.

A known control valve 16 is provided in the rear housing 4 for adjusting pressure in the crank chamber 5, that is, crank chamber pressure Pc. The control valve 16 is disposed in a supply passage (not shown) that interconnects the crank chamber 5 and the discharge chamber 7. The control valve 16 includes a valve mechanism for controlling the opening degree of the supply passage by electromagnetic force of the solenoid. Meanwhile, the crank chamber 5 communicates with the suction chamber 6 through a bleed passage (not shown). Refrigerant gas flows from the discharge chamber 7 to the crank chamber 5 through the supply passage and the control valve 16, while it flows from the crank chamber 5 to the suction chamber 6 through the bleed passage. The crank chamber pressure Pc is adjusted by balancing the refrigerant gas that flows into and out of the crank chamber 5.

Figure 2:
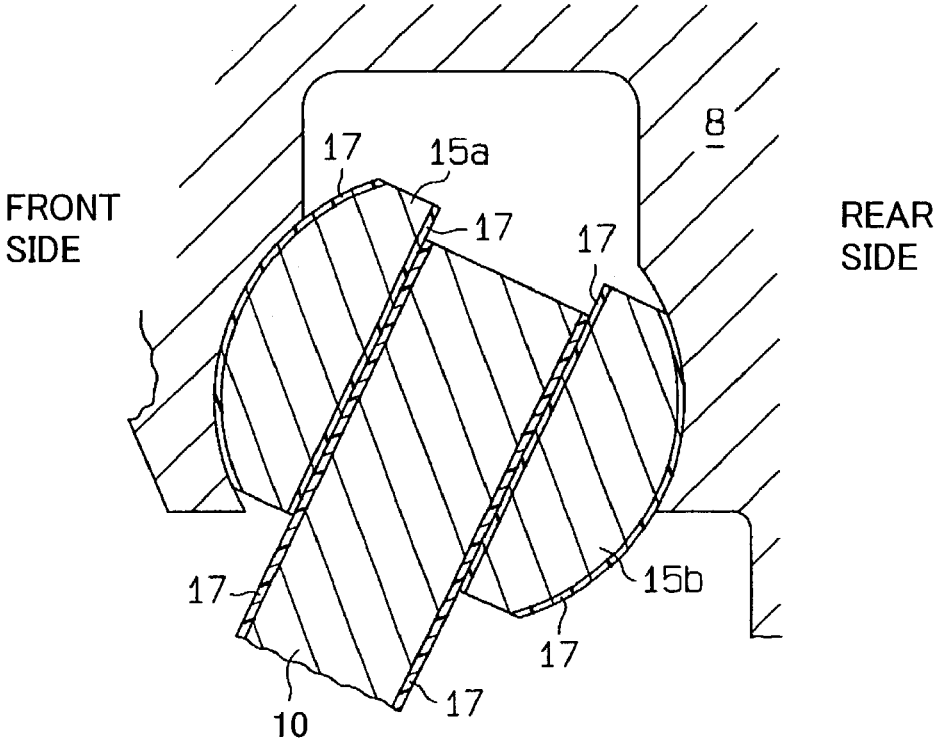
FIG. 2 is a partially enlarged cross-sectional view of a swash plate, shoes and a piston according to the preferred embodiment.

FIG. 2 illustrates a partially enlarged cross-sectional view of the swash plate 10, the shoes 15*a*, 15*b* and the piston 8 according to the preferred embodiment. At least the sliding surfaces of the swash plate 10 and the shoes 15*a*, 15*b*, which are the components of the compressor C, are coated with layers 17 made of silane-modified resin, that is, silane-modified resin layers 17.

The silane-modified resin includes an alkoxysilyl group or an aryloxysilyl group. The alkoxy group of the alkoxysilyl group preferably has 1 to 6 carbon atoms and more preferably has 1 to 4 carbon atoms. For example, a methoxy group, an ethoxy group and a propoxy group correspond to the above alkoxy group. The aryloxy group of the aryloxysilyl group preferably has 6 to 10 carbon atoms and more preferably has 6 to 8 carbon atoms. For example, a phenyloxy group, a dimethylphenyloxy group and a methylphenyloxy group correspond to the above aryloxy group.

The silane-modified resin layer 17 may contain a solid lubricant, such as fluororesin, molybdenum disulfide ("$MoS_2$") and graphite. For example, polytetrafluoroethylene ("PTFE"), perfluoroalkoxy alkane ("PFA"), ethylene-tetrafluoroethylene copolymer ("ETFE") and fluoroethylenepropylene ("FEP") correspond to the above fluororesin.

The swash plate 10 is made of a relatively heavy iron series material, for example, cast iron such as FCD700 according to Japanese Industrial Standards ("JIS") so as to appropriately generate a moment of rotational motion based on centrifugal force upon the rotation of the swash plate 10. On the other hand, the shoes 15*a*, 15*b* are also made of an iron series material such as bearing steel in view of its mechanical strength and the like. Incidentally, aluminum series metal is layered on the sliding surface of the swash plate 10 made of an iron series material, and the silane-modified resin layer 17 is optionally formed on the aluminum layer.

Silane-modified polyamideimide resin is produced by the same procedure disclosed in Unexamined Japanese Patent Publication No. 2001-240670. Namely, polyamideimide resin includes at least one of a carboxyl group and an acid anhydride group at its molecule terminal. Meanwhile, glycidylether group-containing alkoxysilane partial condensate is produced by dealcoholization between glycidol and alkoxysilane partial condensate. Then, the silane-modified polyamideimide resin is produced by ring opening esterification between the polyamideimide resin and the glycidylether group-containing alkoxysilane partial condensate.

The polyamideimide resin is produced by the following procedure. A reactor is equipped with an agitator, a cooling pipe and a thermometer. 1160 gram of N-methylpyrrolidone, 290 gram of xylene, 345.8 gram of trimellitic anhydride and 425.0 gram of 4,4'-diphenylmethane diisocyanate are put in the reactor and are reacted in a nitrogen gas stream for two hours at 90° C. Then, the nitrogen gas stream is stopped, and the temperature is heated up to 135° C. one hour later. After that, the reaction continues for three and half-hours. Then, the reactant is cooled and is diluted by the mixture of N-methylpyrrolidone/xylene with the weight ratio of 4 to 1. Thus, polyamideimide containing 25 percent of non-volatile component is produced.

The glycidylether group-containing alkoxysilane partial condensate is produced by the following procedure. A reactor is equipped with an agitator, a cooling pipe and a thermometer. 250 gram of glycidol (brand name [Epior OH], produced by NOF corporation) and 799.81 gram of tetramethoxysilane partial condensate (brand name [Methylsilicate 51], the average number of silicon: 4) are put in the reactor and is heated up to 90° C. in nitrogen gas stream with its being agitated. After that, 1.00 gram of dibutyltin dilaurate is added as catalyst to perform dealcoholization of methanol. During the dealcoholization, methanol is separated from the reaction system by a separator and is reserved. When the amount of reserved methanol reaches approximately 90 gram, cooling is started for the reactant. It takes 6 hours from the heating until the cooling starts. After the reactant is cooled to 50° C., a nitrogen blow valve and the separator are detached from the reactor. Then, a pressure reducing line is connected to the reactor for maintaining 13 KPa for approximately 15 minutes to remove the redundant methanol in the reaction system by reducing pressure therein. Approximately 21.0 gram of methanol is removed by reducing pressure. After that, a flask of the reactant is cooled to room temperature. Thus, 929.81 gram of glycidylether group-containing alkoxysilane partial condensate is produced. The average number of silicon atoms per molecule of the product is twice as many as the average number of the glycidylether group per molecule of the product.

The silane-modified polyamideimide is produced by the following procedure. A reactor is equipped with an agitator, a cooling pipe and a thermometer. 200 gram of polyamideimide resin solution and 5.17 gram of glycidylether group-containing alkoxysilane partial condensate are produced by the above procedures and are put in the reactor. The mixture is heated up to 95° C. After the temperature reaches 95° C., the reaction is maintained for four hours. Then, 8.26 gram of N-methylpyrrolidone is added to the reaction system, and the reactant is cooled. Thus, silane-modified polyamideimide resin containing 25% of non-volatile component is produced.

When the silane-modified polyamideimide resin is produced, the content of silica in the silane-modified polyamideimide resin varies with type and quantity of polyamideimide resin solution and of glycidylether group-containing alkoxysilane partial condensate, and quantity of N-methylpyrrolidone.

When the silane-modified resin layers 17 are formed on the sliding surfaces of the swash plate 10 and the shoes 15*a*, 15*b*, solution or silane-modified resin varnish, which includes silane-modified resin mixed with solvent, is prepared. After the sliding surfaces are degreased, the silane-modified resin varnish is applied on the sliding surfaces. The applied silane-modified resin varnish is calcined to form the silane-modified resin layers 17 having a predetermined thickness. Each of the silane-modified resin layers 17 has a thickness of 5 to 50 μm and preferably has a thickness of 10 to 30 μm.

In the case of the silane-modified polyamideimide resin varnish that is made from silane-modified resin of polyamideimide, N-methyl-2-pyrrolidone ("NMP") or NMP/xylene are used as the solvent. In the case of the silane-modified epoxy resin varnish, methyl ethyl ketone ("MEK") is used as the solvent.

The conditions of calcinations are different for each kind of resin varnish. In the case of the silane-modified polyamideimide resin varnish, it is calcined for 30 minutes at 80° C., for 30 minutes at 150° C. and then for 30 minutes at 200° C. In the case of the silane-modified epoxy resin varnish, it is calcined for 30 minutes at 100° C. and then for 60 minutes at 200° C.

The operation of the above compressor C will now be described. Referring back to FIG. 1, the swash plate 10 integrally rotates with the rotation of the drive shaft 9. The rotation of the swash plate 10 is converted to the reciprocation of the pistons 8 though the shoes 15*a*, 15*b*. Each of the pistons 8 reciprocates at a stroke that corresponds to the inclination angle of the swash plate 10. As the above drive continues, the refrigerant gas is introduced from the suction chamber 6. The introduced refrigerant gas is compressed and then is discharged to the discharge chamber 7. Thus, suction, compression and discharge sequentially repeat. The refrigerant gas supplied into the suction chamber 6 from an external refrigerant circuit (not shown) is introduced into the cylinder bore 1*a* through a suction port. After the refrigerant gas is compressed by the movement of the piston 8, it is discharged to the discharge chamber 7 through a discharge port. The refrigerant gas discharged into the discharge chamber 7 is sent to the external refrigerant circuit through an outlet.

The opening degree of the control valve 16 is adjusted in response to cooling load of the compressor C, thus varying the amount of refrigerant communicated from the discharge chamber 7 to the crank chamber 5. When the cooling load is high and pressure in the suction chamber 6 (suction chamber pressure Ps) is high, the opening degree of the control valve 16 reduces. As a result, the crank chamber pressure Pc reduces, and the inclination angle of the swash plate 10 increases. Then the stroke of the pistons 8 increases so that the compressor C is operated in a relatively large displacement volume. On the other hand, when the cooling load is low and the suction chamber pressure Ps is low, the opening degree of the control valve 16 increases. As a result, the crank chamber pressure Pc increases, and the inclination angle of the swash plate 10 reduces. Then, the stroke of the pistons 8 reduces so that the compressor C is operated in a relatively small displacement volume.

Since the silane-modified resin layers 17 are formed on the sliding surfaces of the swash plate 10 and the shoes 15*a*, 15*b*, sliding performance and durability improve at the sliding surfaces. Accordingly, reliability and durability of the compressor C improve.

Examples 1 to 6 and Comparative Examples 1 to 4 are prepared by the following procedures.

To compare sliding performance of the silane-modified resin layer 17 with a conventional art, resin varnishes are respectively prepared by silane-modified resin and by non-silane-modified resin. Each different resin layer having the same thickness of 20 μm is formed on the degreased surface of a metal base member to prepare evaluation samples. Then, friction coefficient, abrasion, seizure resistance and adhesion to the base member are evaluated at each sample.

The evaluation samples are formed in the following procedure.

EXAMPLE 1

Silane-modified polyamideimide resin varnish (30 weight percent of the solid component of PAI resin and NMP/xylene solvent) containing 2 weight percent of silica in its cured residue is prepared. The above resin varnish is applied by a barcoater on an aluminum base member, the surface of which has been degreased. The aluminum base member with the resin varnish is calcined for 30 minutes at 80° C., for 30 minutes at 150° C. and then for 30 minutes at 200° C. Thus, a layer having a thickness of 20 μm is formed on the aluminum base member.

COMPARATIVE EXAMPLE 1

Polyamideimide resin varnish (30 weight percent of the solid component of PAI resin and NMP/xylene solvent: HPC-5000 produced by Hitachi Chemical Co., Ltd.) is prepared in place of the silane-modified polyamideimide resin varnish. Other than that, a layer having a thickness of 20 μm is formed on an aluminum base member by the same procedure of Example 1.

EXAMPLE 2

Solid lubricant is added to silane-modified polyamideimide resin varnish (30 weight percent of the solid component of PAI resin and NMP/xylene solvent) containing 2 weight percent of silica in its cured residue. After the mixture of the resin varnish and the solid lubricant has been agitated, it is passed through a roll mill twice. Thus, a material for coating is prepared. PTFE powder, $MoS_2$ powder and graphite powder are added together as the solid lubricant. The coating material is applied on the degreased surface of an aluminum base member by a barcoater and is calcined for 30 minutes at 80° C., for 30 minutes at 150° C. and then for 30 minutes at 200° C. Thus, a layer having a thickness of 20 μm is formed on the aluminum base member. The composition rate of the solid component of the coating material is 65 weight percent of silane-modified polyamideimide resin, 10 weight percent of PTFE, 20 weight percent of $MoS_2$ and 5 weight percent of graphite.

COMPARATIVE EXAMPLE 2

Polyamideimide resin varnish (30 weight percent of the solid component of PAI resin and NMP/xylene solvent: HPC-5000 produced by Hitachi Chemical Co., Ltd.) is prepared in place of the silane-modified polyamideimide resin varnish. Other than that, a layer having a thickness of 20 μm is formed on an aluminum base member by the same procedure of Example 2.

EXAMPLE 3

Curing agent (phenol novolac resin), silane curing catalyst (tin 2-ethyl hexanoic acid) and solid lubricant are added to silane-modified epoxy resin varnish (50 weight percent of epoxy resin and MEK solvent) containing 36 weight percent of silica in its cured residue. After the mixture of the resin varnish, the curing agent, the catalyst and the solid lubricant has been agitated, a material for coating is prepared. PTFE powder, $MoS_2$ powder and graphite powder are added together as the solid lubricant. The coating material is applied on the degreased surface of an aluminum base member by a barcoater and is calcined for 30 minutes at 100° C. and then for 60 minutes at 200° C. Thus, a layer having a thickness of 20 μm is formed on the aluminum base member. The composition rate of the solid component of the coating material is 65 weight percent of silane-modified polyamideimide resin, 10 weight percent of PTFE, 20 weight percent of $MoS_2$ and 5 weight percent of graphite.

COMPARATIVE EXAMPLE 3

Epoxy resin varnish (50 weight percent of epoxy resin and MEK solvent) is prepared in place of the silane-modified epoxy resin varnish. Other than that, a layer having a thickness of 20 μm is formed on an aluminum base member by the same procedure of Example 3.

EXAMPLES 4 AND 5

Solid lubricant is added to silane-modified polyamideimide resin varnish (30 weight percent of the solid component of PAI resin and NMP/xylene solvent) containing 5 weight percent of silica in Example 4 or 7 weight percent of silica in Example 5 in its cured residue. After the mixture of the resin varnish and the solid lubricant has been agitated, it is passed through a roll mill twice. Thus, a material for coating is prepared. PTFE powder, $MOS_2$ powder and graphite powder are added together as the solid lubricant. The coating material is applied on the degreased surface of an aluminum base member by a barcoater and is calcined for 30 minutes at 80° C., for 30 minutes at 150° C. and then for 30 minutes at 200° C. Thus, a layer having a thickness of 20 μm is formed on the aluminum base member. The composition rate of the solid component of the coating material is 65 weight percent of silane-modified polyamideimide resin, 10 weight percent of PTFE, 20 weight percent of $MoS_2$ and 5 weight percent of graphite.

EXAMPLE 6

Solid lubricant is added to silane-modified polyamideimide resin varnish (30 weight percent of the solid component of PAI resin and NMP/xylene solvent) containing 2 weight percent of silica in its cured residue. After the mixture of the resin varnish and the solid lubricant has been agitated, it is passed through a roll mill twice. Thus, a material for coating is prepared. PTFE powder, $MoS_2$ powder and graphite powder are added together as the solid lubricant. The coating material is applied on the degreased surface of a cast iron FCD700 base member by a barcoater and is calcined for 30 minutes at 80° C., for 30 minutes at 150° C. and then for 30 minutes at 230° C. Thus, a layer having a thickness of 20 μm is formed on the FCD700 base member. The composition rate of the solid component of the coating material is 65 weight percent of silane-modified polyamideimide resin, 10 weight percent of PTFE, 20 weight percent of $MoS_2$ and 5 weight percent of graphite.

COMPARATIVE EXAMPLE 4

Polyamideimide resin varnish (30 weight percent of the solid component of PAI resin and NMP/xylene solvent: HPC-5000 produced by Hitachi Chemical Co., Ltd.) is prepared in place of the silane-modified polyamideimide resin varnish. Other than that, a layer having a thickness of 20 μm is formed on a cast iron FCD700 base member by the same procedure of Example 6.

An evaluation test of friction coefficient and abrasion is performed in the following procedure.

Immediate friction coefficient and friction coefficient 100 hours after initiation of the test are examined by a thrust tester under the conditions of 60 m/min of sliding speed and 9.8 MPa of contact pressure respectively against gray cast iron and iron SUJ2 according to JIS with its being lubricated.

Figure 3A:
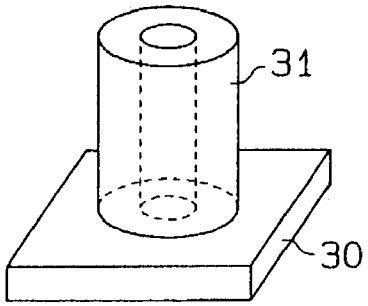
FIG. 3A is a schematic perspective view of an evaluation sample and a contact material that is rotated with its being pressed against the evaluation sample.
Figure 3B:
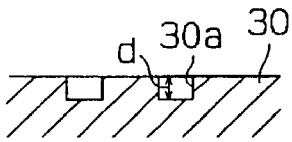
FIG. 3B is a schematic cross-sectional view of grooves formed in the sliding surface of the evaluation sample facing the contact material.

FIG. 3A illustrates a schematic perspective view of an evaluation sample 30 and a contact material 31 that is rotated with its being pressed against the evaluation sample 30. FIG. 3B illustrates a schematic cross-sectional view of grooves 30*a* formed in the sliding surface of the evaluation sample 30 facing the contact material 31. The depths d of the grooves 30*a* are measured and are evaluated as abrasion.

An evaluation test of seizure resistance load is performed in the following procedure.

Contact pressure when seizure occurs is examined by a thrust tester under the condition of 60 m/min of sliding speed respectively against gray cast iron and iron SUJ2 with its being lubricated while the contact pressure is periodically increased (1 MPa/2 min).

Gray cast iron FC-25 according to JIS is used as the contact material 31 for the Examples 1 to 5 and the Comparative Examples 1 to 3. Iron SUJ2 is used as the contact material 31 for the Example 6 and the Comparative Example 4 because the base member of the evaluation sample is made of cast iron FCD700.

Evaluation of adhesion to the base member is performed in the following procedure.

According to K5400 cross-cut retention of JIS, adhesion at the initial stage and 100 hours later of autoclave test under the condition of 121° C. and 202 KPa are evaluated.

The results of each test are shown in TABLE 1.

According to TABLE 1, when the silane-modified resin layer is formed on the sliding surface, sliding performance largely improves in comparison to the corresponding non-silane-modified resin layer formed on the sliding surface.

TABLE 1

| | CONTENT OF SILICA (weight percent) | FRICTION COEFFICIENT INITIAL STAGE | FRICTION COEFFICIENT 100 HOURS LATER | ABRASION (μm) | SEIZURE RESISTANCE (MPa) | ADHESION INITIAL STAGE | ADHESION 100 HOURS LATER |
|---|---|---|---|---|---|---|---|
| EXAMPLE 1 | 2 | 0.031 | 0.028 | 4.7 | 20 | 100/100 | 100/100 |
| EXAMPLE 2 | 2 | 0.028 | 0.022 | 5.8 | 24.5 or above | 100/100 | 100/100 |
| EXAMPLE 3 | 36 | 0.041 | 0.031 | 4.7 | 24.5 or above | 100/100 | 100/100 |
| EXAMPLE 4 | 5 | 0.030 | 0.026 | 4.7 | 24.5 or above | 100/100 | 100/100 |
| EXAMPLE 5 | 7 | 0.027 | 0.025 | 4.6 | 24.5 or above | 100/100 | 100/100 |
| EXAMPLE 6 | 2 | 0.034 | 0.031 | 6.4 | 24.5 or above | 100/100 | 100/100 |
| COMPARATIVE EXAMPLE 1 | 0 | 0.068 | 0.052 | 8.7 | 11 | 100/100 | 0/100 |
| COMPARATIVE EXAMPLE 2 | 0 | 0.066 | 0.062 | 15.3 | 19.5 | 100/100 | 0/100 |
| COMPARATIVE EXAMPLE 3 | 0 | 0.072 | 0.066 | 9.6 | 18 | 100/100 | 0/100 |
| COMPARATIVE EXAMPLE 4 | 0 | 0.058 | 0.049 | 12.7 | 16.5 | 100/100 | 0/100 |

According to the test results of the Example 1 and the Comparative Example 1 in TABLE 1, seizure resistance, abrasion resistance and adhesion to the base member (the aluminum base member) improve in the silane-modified polyamideimide resin layer in comparison to the non-silane-modified polyamideimide resin layer. Meanwhile, according to the test results of the Example 2 and the Comparative Example 2 in TABLE 1, when the silane-modified polyamideimide resin layer contains the solid lubricant, seizure resistance, abrasion resistance and adhesion to the base member (the aluminum base member) improve in comparison to the polyamideimide resin layer that does not contain a solid lubricant.

According to the test results of the Examples 1 and 2 in TABLE 1, when the silane-modified polyamideimide resin layer contains the solid lubricant, seizure resistance improves in comparison to the layer that does not contain a solid lubricant.

According to the Example 3 and the Comparative Example 3, when the silane-modified epoxy resin layer contains the solid lubricant, seizure resistance, abrasion resistance and adhesion to the base member (the aluminum base member) improve in comparison to the non-silane-modified epoxy resin layer that contains solid lubricant.

According to the Examples 2, 4 and 5, even if the content of silica is varied in its cured residue of the silane-modified polyamideimide resin for forming the silane-modified polyamideimide resin layer, sliding characteristics are equivalent.

According to the Example 6 and the Comparative Example 4, even if the material of the sliding member is replaced from aluminum to cast iron, seizure resistance, abrasion resistance and adhesion to the base member improve in the silane-modified polyamideimide resin layer in comparison to the non-silane-modified polyamideimide layer.

EXAMPLES 7 TO 9 AND COMPARATIVE EXAMPLE 5

Evaluation test of seizure at the sliding portions between the swash plate and the shoes is performed under non-lubricated condition in the following procedure.

Figure 4:
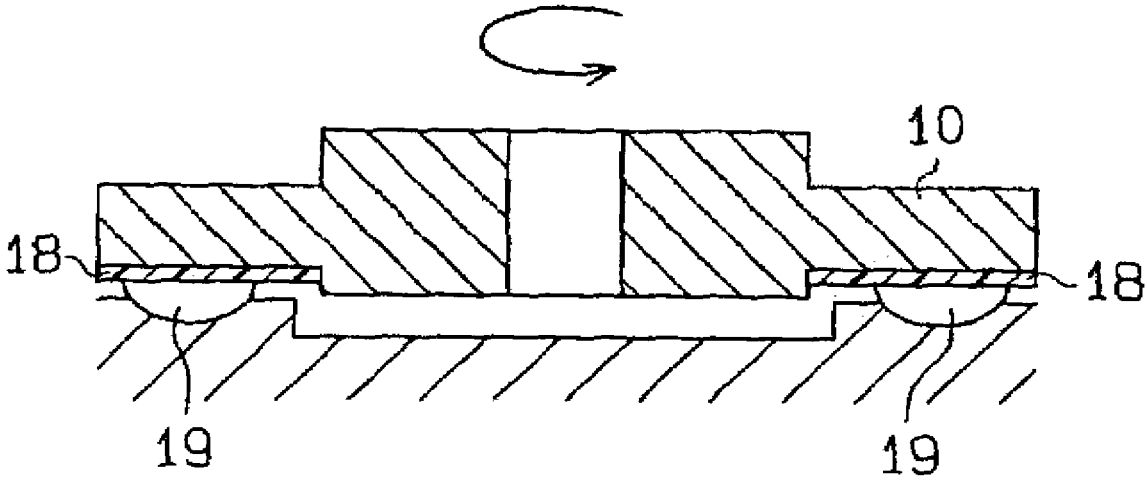
FIG. 4 is a schematic cross-sectional view illustrating a seizure test under non-lubricated condition.

FIG. 4 illustrates a schematic cross-sectional view illustrating evaluation test of seizure under non-lubricated condition. A lubricating layer 18 is formed on the sliding surface of the swash plate 10 made of cast iron FCD700, and time period to seizure under non-lubricated condition is measured under the conditions of 10.5 m/s of rotational speed and 2000 N of load with the lubricating layer 18 being contacted with plane surfaces of shoes 19 made of bearing steel.

The lubricating layer 18 is not directly formed on the surface of the swash plate 10. First, an aluminum spraying layer (not shown) is formed on the surface of the swash plate 10. Then, the coating material is applied thereon by a barcoater and is calcined for an hour at 230° C. Thus, the lubricating layer 18 having a thickness of 15 μm is formed on the aluminum spraying layer.

In the Examples 7 to 9, solid lubricant is added to respective silane-modified polyamideimide resin varnishes (30 weight percent of the solid component of PAI resin and NMP/xylene solvent), each including different content of silica in their cured residue of the resin varnishes. Each mixture of the resin varnish and the solid lubricant is agitated and is passed through a roll mill twice. Thus, materials for coating are prepared. The content of silica is 2 weight percent in the Example 7, 5 weight percent in the Example 8, and 7 weight percent in the Example 9, respectively. $MoS_2$ powder, graphite powder and PTFE powder are added together as the solid lubricant. The composition rate of the solid component of the coating material is 65 weight percent of silane-modified polyamideimide resin, 20 weight percent of $MoS_2$, 10 weight percent of graphite and 5 weight percent of PTFE.

In the Comparative Example 5, polyamideimide resin varnish (30 weight percent of the solid component of PAI resin and NMP/xylene solvent: HPC-5000 produced by Hitachi Chemical Co., Ltd.) is prepared in place of the silane-modified polyamideimide resin varnish. Other than that, a material for coating is the same as in the Examples 7 to 9. The lubricating layer 18 is formed on the swash plate 10 made of cast iron FCD700, the surface of which is coated with an aluminum spraying layer (not shown), under the same condition as in the Examples 7 to 9. The test results are shown in TABLE 2.

TABLE 2

| | CONTENT OF SILICA (weight percent) | COMPOSITION OF LAYER (weight percent) CONTENT OF RESIN | $MoS_2$ | GRAPHITE | PTFE | SEIZURE TIME (second) |
|---|---|---|---|---|---|---|
| EXAMPLE 7 | 2 | 65 | 20 | 10 | 5 | 761 |
| EXAMPLE 8 | 5 | 65 | 20 | 10 | 5 | 600 |
| EXAMPLE 9 | 7 | 65 | 20 | 10 | 5 | 456 |
| COMPARATIVE EXAMPLE 5 | 0 | 65 | 20 | 10 | 5 | 190 |

According to the test results of the Examples 7 to 9 and the Comparative Example 5 in TABLE 2, seizure resistance under non-lubricated condition largely improves for the silane-modified polyamideimide resin layer containing solid lubricant in comparison to the non-silane-modified polyamideimide resin layer.

According to the Examples 7 to 9, when 20 weight percent of $MOS_2$, 10 weight percent of graphite and 5 weight percent of PTFE are contained as solid lubricant, seizure resistance of the silane-modified polyamideimide resin layer under non-lubricated condition improves as the content of silica reduces.

According to the preferred embodiment, the following advantageous effects are obtained.

(1) The silane-modified resin layers, the resin of which is soluble and is higher in thermal resistance than epoxy resin, are formed at least on the sliding surfaces of the metal components. Accordingly, the silane-modified resin forms the layers on the sliding surfaces of the metal sliding components, such as the swash plate 10 and the shoes 15*a*, 15*b*, so that silicon in the layer is uniformly dispersed. As a result, seizure resistance and abrasion resistance improve.

(2) In comparison to the pure silane-modified resin layer, the silane-modified resin layer containing the solid lubricant has improved in seizure resistance.

(3) The silane-modified resin includes an alkoxysilyl group or an aryloxysilyl group. The dissolved silane-modified resin is applied on a sliding surface and is calcined. Thus, the layer is formed on the sliding surface. Since the silane-modified resin reacts with a hydroxyl group on the surface of the metal of the sliding component, adhesion to the metal surface improves.

(4) When the silane-modified polyamideimide resin is used as the silane-modified resin, it is lower in heat resistance than polyimide resin. However, the silane-modified polyamideimide resin easily dissolves in solvent so that it is stable as a coating material, and it is relatively cheap. Accordingly, the silane-modified resin layer 17 is easily formed with low-cost, by the silane-modified polyamideimide resin.

(5) When the silane-modified epoxy resin is used as the silane-modified resin, it is lower in cost than the silane-modified polyamideimide resin or the silane-modified polyimide resin.

(6) Since the silane-modified resin layers 17 are formed on the sliding surfaces of the sliding components, such as the swash plate 10 and the shoes 15*a*, 15*b*, sliding performance and durability of the swash plate 10 and the shoes 15*a*, 15*b* improve. As a result, lubrication and durability of the swash plate 10, which is forced to be in extremely tough sliding environment, improve so that reliability and durability of the compressor C improve.

The present invention is not limited to the embodiment described above but may be modified into the following alternative embodiments.

In alternative embodiments to those of the preferred embodiment, when solid lubricant is used, the solid lubricant is not limited to the mixture of three materials, PTFE, $MoS_2$ and graphite. The mixture of two materials may be used or one of the three materials may be used.

In alternative embodiments to those of the preferred embodiment, another fluororesin, such as PFA, FEP and ETFE, may be used for the solid lubricant in place of PTFE. Furthermore, another material other than fluororesin, $MoS_2$ and graphite may be used for the solid lubricant.

In alternative embodiments to those of the preferred embodiment, the content of the solid lubricant is not limited to the content described in the preferred embodiment. The content of the solid lubricant may appropriately be varied.

In alternative embodiments to those of the preferred embodiment, the silane-modified resin layer 17 may further include hard particles, such as alumina, silica, silicon carbide and silicon nitride, extreme-pressure agent made of metallic compound including sulfur, such as ZnS, Ag2S and CuS, and surface-active agent in addition to the solid lubricant.

In alternative embodiments to those of the preferred embodiment, the silane-modified resin layer 17 may be applied to sliding components other than the swash plate 10 and the shoes 15*a*, 15*b* such as the piston 8 and the lug plate 11. With respect to the piston 8, the silane-modified resin layer 17 is formed on at least one of the sliding surfaces of the piston 8 facing the cylinder block 1, the front housing 2 and the shoes 15*a*, 15*b*. Meanwhile, when a plane bearing is used for supporting the drive shaft 9, the silane-modified resin layer 17 may be formed on the sliding surface of the plane bearing.

Figure 5:
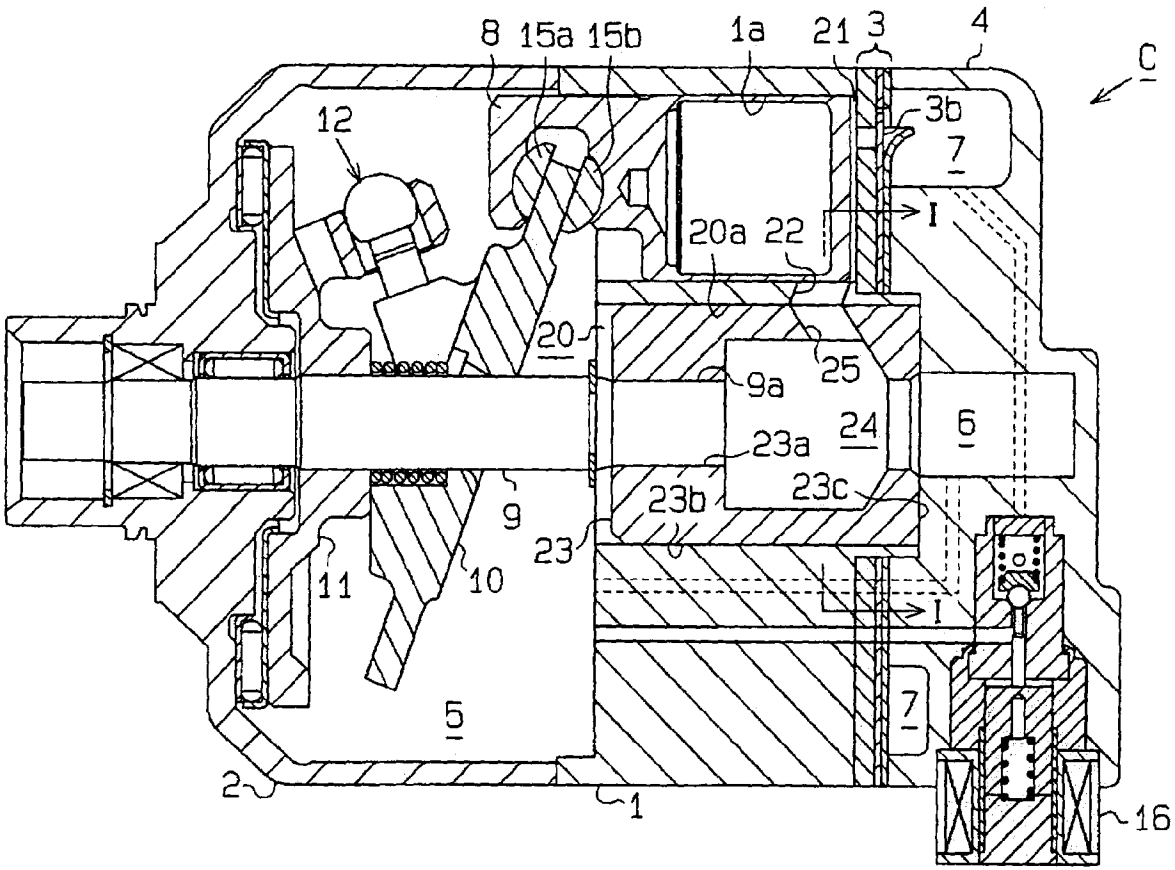
FIG. 5 is a longitudinal cross-sectional view of a compressor according to an alternative embodiment.

In alternative embodiments to those of the preferred embodiment, instead of a swash plate type compressor or a piston type compressor having a reed-type valve for a suction valve, a piston type compressor having a rotary valve may be used. FIG. 5 illustrates a longitudinal cross-sectional view of a compressor C. The front side and the rear side of the compressor C respectively correspond to the left side and the right side in FIG. 5. A columnar valve chamber 20 is defined in the cylinder block 1 and extends from the middle of the cylinder block 1 to the middle of the rear housing 4. The valve chamber 20 communicates with the suction chamber 6 at its rear side and also communicates with a plurality of compression chambers 21 through respective suction ports 22 (See FIG. 6).

The valve chamber 20 rotatably accommodates a rotary valve 23. The rotary valve is cylindrical in shape and has a closed end at its one end. The other end of the rotary valve 23 communicates with the suction chamber 6. The closed end has a fitting hole 23*a* at its middle. The rotary valve 23 is made of aluminum series material. The rear end of the drive shaft 9 is positioned in the valve chamber 20. A small diameter portion 9*a* of the rear end of the drive shaft 9 is press-fitted into the fitting hole 23*a* of the rotary valve 23. Accordingly, the rotary valve 23 is integrated with the drive shaft 9 and is synchronously rotated with the drive shaft 9. That is, the rotary valve 23 is synchronously rotated with the reciprocation of the pistons 8.

Figure 6:
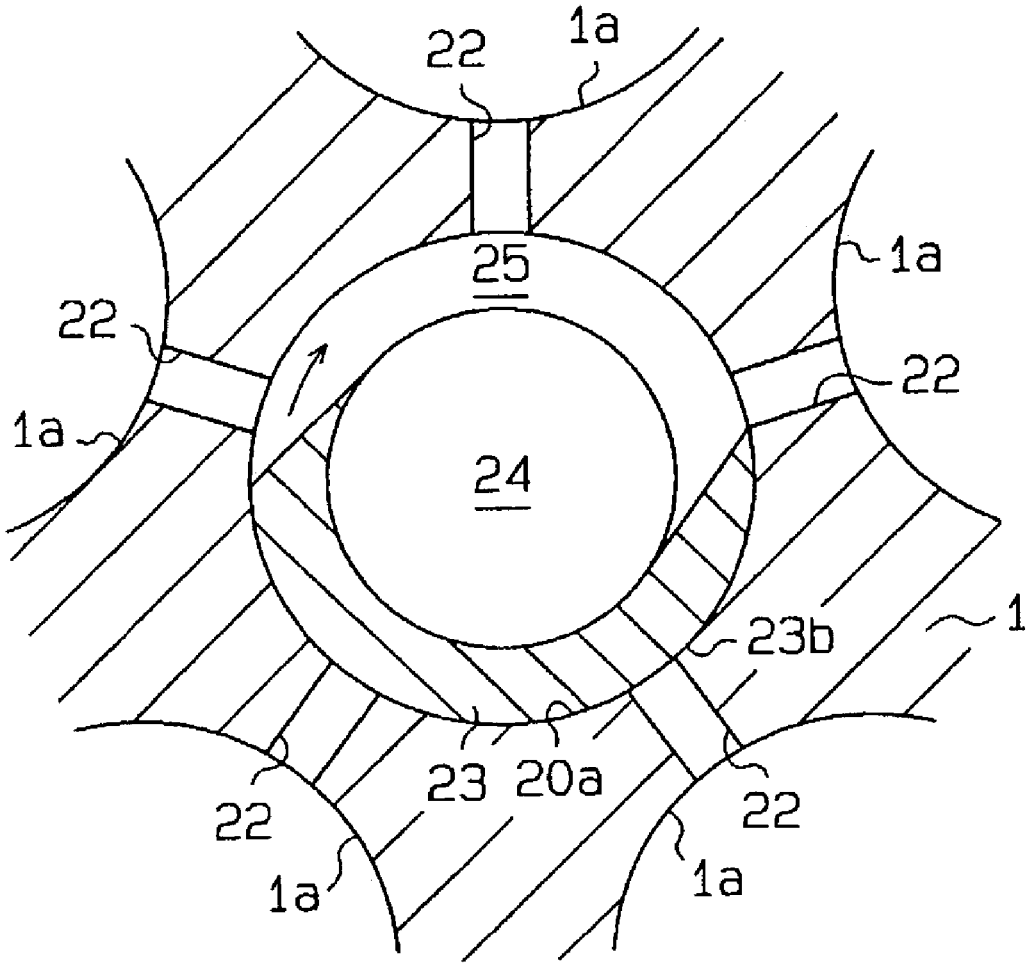
FIG. 6 is a cross-sectional end view that is taken along the line I-I in FIG. 5.

FIG. 6 illustrates a cross-sectional end view that is taken along the line I-I in FIG. 5. The inner cylindrical space of the rotary valve 23 forms an introducing chamber 24 that communicates with the suction chamber 6. A suction guide groove 25 is formed in an outer circumferential surface 23*b* of the rotary valve 23 and extends in a predetermined angular range. The suction guide groove 25 always communicates with the introducing chamber 24. The suction guide groove 25 and the suction ports 22 constitute a refrigerant gas passage between the introducing chamber or a suction pressure region 24 and the compression chambers 21. The rotary valve 23 opens and closes the refrigerant gas passage as it rotates.

Referring back to FIG. 5, the silane-modified resin layers (not shown) are formed on the sliding surfaces that include the outer circumferential surface 23*b* and a rear end surface 23*c*. In this structure, the drive shaft 9 is rotatably supported by the housing through the rotary valve 23. The valve chamber 20 for accommodating the rotary valve 23 also serves as an accommodating chamber for a bearing. Accordingly, it is enough to machine an inner circumferential surface 20*a* of the valve chamber 20 with high accuracy to prevent gas from leaking from a clearance between the outer circumferential surface 23*b* and the inner circumferential surface 20*a*. As a result, a compressor having high silence and high compression efficiency is manufactured with low-cost.

In alternative embodiments to those of the preferred embodiment, if the silane-modified resin layer 17 is formed at least on the sliding surface of the sliding component, it may also be formed on a portion other than the sliding surface.

In alternative embodiments to those of the preferred embodiment, the material of the swash plate 10 is not limited to iron series metal. Aluminum series metal, such as aluminum and aluminum alloy, or stainless steel may be used.

In alternative embodiments to those of the preferred embodiment, the compressor C is not limited to a variable displacement type swash plate compressor. The compressor C may be a double-headed piston type or a fixed displacement type swash plate compressor. A swash plate type compressor may include a swash plate that does not integrally rotate with a drive shaft but oscillates in accordance with the rotation of the drive shaft. Furthermore, the compressor may be a scroll type compressor, a vane type compressor and another type of compressor.

In alternative embodiments to those of the preferred embodiment, the layer 17 is not limited to the sliding component of a compressor. The layer 17 may be formed on the sliding component of another machine.

Therefore, the present examples and embodiments are to be considered as illustrative and not restrictive, and the invention is not to be limited to the details given herein but may be modified within the scope of the appended claims.

What is claimed is:

1. A sliding component, which is a component of a compressor, comprising:

a metal base member having a sliding surface; and a coating layer made of silane-modified resin, the silane-modified resin being made from resin that is soluble in solvent and is equal to or higher in heat-resistant than epoxy resin, the coating layer being formed on the sliding surface, wherein the compressor is a piston type, the compressor includes a housing, a drive shaft and a rotary valve that corresponds to the sliding component, the rotary valve is integrated with the drive shaft and supports the drive shaft on the housing, the housing defines a compression chamber, a suction pressure region and a gas passage, the gas passage interconnects the compression chamber and the suction pressure region, and the rotary valve opens and closes the gas passage as the rotary valve synchronously rotates with the drive shaft.

2. The sliding component according to claim 1, wherein the coating layer contains solid lubricant.

3. The sliding component according to claim 2, wherein the solid lubricant includes at least one of fluororesin, molybdenum disulfide and graphite.

4. The sliding component according to claim 3, wherein the fluororesin is selected from the group consisting of polytetrafluoroethylene, perfluoroalkoxy alkane, ethylene-tetrafluoroethylene copolymer and fluoroethylenepropylene.

5. The sliding component according to claim 2, wherein the coating layer contains at least one of hard particles, extreme-pressure agent and surface-active agent.

6. The sliding component according to claim 1, wherein the silane-modified resin includes one of an alkoxysilyl group and an aryloxysilyl group.

7. The sliding component according to claim 6, wherein an alkoxy group of the alkoxysilyl group includes 1 to 6 carbon atoms.

8. The sliding component according to claim 7, wherein the alkoxy group includes 1 to 4 carbon atoms.

9. The sliding component according to claim 8, wherein the alkoxy group is selected from the group consisting of a methoxy group, an ethoxy group and a propoxy group.

10. The sliding component according to claim 6, wherein an aryloxy group of the aryloxysilyl group includes 6 to 10 carbon atoms.

11. The sliding component according to claim 10, wherein the aryloxy group includes 6 to 8 carbon atoms.

12. The sliding component according to claim 11, wherein the aryloxy group is selected from the group consisting of a phenyloxy group, a dimethylphenyloxy group and a methylphenyloxy group.

13. The sliding component according to claim 1, wherein the silane-modified resin is a silane-modified polyamideimide resin.

14. The sliding component according to claim 13, wherein the polyamideimide resin includes at least one of a carboxyl group and an acid anhydride group at its terminal of molecule, glycidylether group-containing alkoxysilane partial condensate being obtained by dealcoholization of glycidol and alkoxysilane partial condensate, the silane-modified resin being obtained by ring opening esterification reaction between the polyamideimide resin and the glycidylether group-containing alkoxysilane partial condensate.

15. The sliding component according to claim 13, wherein the coating layer of the silane-modified resin is formed by applying and calcining silane-modified polyamideimide resin varnish containing 1 to 10 weight percent of silica in its cured residue.

16. The sliding component according to claim 1, wherein the silane-modified resin is a silane-modified epoxy resin.

17. The sliding component according to claim 1, wherein the silane-modified resin is a silane-modified polyimide resin.

* * * * *